US011781468B2

(12) United States Patent
Tanaka

(10) Patent No.: US 11,781,468 B2
(45) Date of Patent: Oct. 10, 2023

(54) WORK VEHICLE

(71) Applicant: Kubota Corporation, Osaka (JP)

(72) Inventor: Kazuhiro Tanaka, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 17/090,768

(22) Filed: Nov. 5, 2020

(65) Prior Publication Data

US 2021/0270180 A1 Sep. 2, 2021

(30) Foreign Application Priority Data

Feb. 28, 2020 (JP) ..... 2020-033521

(51) Int. Cl.
*F01P 7/16* (2006.01)
*F01P 3/20* (2006.01)

(52) U.S. Cl.
CPC ..... *F01P 7/161* (2013.01); *F01P 3/20* (2013.01); *F01P 2025/36* (2013.01); *F01P 2050/22* (2013.01)

(58) Field of Classification Search
CPC ..... F01P 7/161; F01P 3/20; F01P 2025/36; F01P 2050/22
USPC ..... 236/34
See application file for complete search history.

(56) References Cited

U.S. PATENT DOCUMENTS 6,199,516 B1 3/2001 Katayama
11,067,031 B2 7/2021 Kitagawa et al.
11,333,100 B2 5/2022 Kitagawa et al.
11,649,784 B2 5/2023 Kitagawa et al.
2006/0005789 A1* 1/2006 Miura ..... F01P 7/16 123/41.1
2009/0205590 A1* 8/2009 Vetrovec ..... F28F 1/40 123/41.14
2011/0094811 A1* 4/2011 Suzuki ..... B60K 11/04 296/210
2013/0125843 A1* 5/2013 Fukuoka ..... F01P 3/02 123/41.1

(Continued)

FOREIGN PATENT DOCUMENTS

EP 3726044 A1 10/2020
JP 144738 Y2 12/1989

(Continued)

*Primary Examiner* — Yi-Kai Wang
(74) *Attorney, Agent, or Firm* — THE WEBB LAW FIRM

(57) ABSTRACT

A thermostat is provided at a connection portion between a cooling water supply passage and a bypass passage. When the temperature of the cooling water lies in a low temperature range lower than a first reference temperature, the thermostat allows introduction of the cooling water from the cooling water discharge passage into the cooling water supply passage via the bypass passage and also prevents introduction of the cooling water from the radiator into the engine via the cooling water supply passage. When the temperature of the cooling water lies in a high temperature range equal to or higher than a second reference temperature which is higher than the first reference temperature, the thermostat allows introduction of the cooling water from the radiator into the engine via the cooling water supply passage and also prevents introduction of the cooling water from the cooling water discharge passage into the cooling water supply passage via the bypass passage.

3 Claims, 4 Drawing Sheets

(56) References Cited

U.S. PATENT DOCUMENTS

| | | | | |
|---|---|---|---|---|
| 2020/0340423 | A1* | 10/2020 | Kitagawa ..... | F01P 7/16 |
| 2021/0301758 | A1 | 9/2021 | Kitagawa et al. | |
| 2022/0268235 | A1 | 8/2022 | Kitagawa et al. | |

FOREIGN PATENT DOCUMENTS

| | | | |
|---|---|---|---|
| JP | 4134729 | U | 12/1992 |
| JP | 4134730 | U | 12/1992 |
| JP | 10339136 | A | 12/1998 |
| JP | 11159329 | A | 6/1999 |
| JP | 2018204498 | A | 12/2018 |
| JP | 2019108810 | A | 7/2019 |
| WO | 2019116835 | A1 | 6/2019 |

* cited by examiner

Fig.6

| temperature of cooling water ( temperature range of cooling water ) | operational states of thermostat | |
|---|---|---|
| | communication between first passage portion and second passage portion | communication between bypass passage and second communication portion |
| T<T1 (low temperature range ) | closed | opened |
| T1≦T<T2 (intermediate temperature range) | opened | opened |
| T2≦T (high temperature range) | opened | closed |

WORK VEHICLE

CROSS-REFERENCE TO RELATED APPLICATION

This application claims priority to Japanese Patent Application No. 2020-033521 filed Feb. 28, 2020, the disclosure of which is hereby incorporated by reference in its entirety.

BACKGROUND OF THE INVENTION

1. Field of the Invention

The present invention relates to a work vehicle.

2. Description of Related Art

Conventionally, as a work vehicle, there is known a work vehicle described in e.g. JP2018-204498A. The work vehicle described in Patent Document 1 includes a water-cooled engine (referred to as an "engine (14)" in the document), a radiator for cooling water for cooling the engine (referred to as "radiator (8)" in the document), and a thermostat.

With the above-described work vehicle, even when the temperature of the cooling water is low, since the cooling water from the engine which has passed through a leak hole of the thermostat passes and circulates through the radiator, an engine warm-up operation takes long time. Further, if the leak hole of the thermostat were omitted in order to shorten the time for engine warmup, hunting of temperature of the cooling water would occur. In view of the above-described state of the art, there is a need for a work vehicle that can realize accelerated warmup of engine, without hunting of the cooling water temperature.

SUMMARY OF THE INVENTION

A work vehicle comprising:

a water-cooled engine;

a radiator for cooling water for cooling the engine;

a cooling water passage provided between the engine and the radiator, the cooling water passage including:

a cooling water supply passage for supplying the cooling water to the engine;

a cooling water discharge passage for discharging the cooling water from the engine; and a bypass passage that connects the cooling water supply passage with the cooling water discharge passage; and a thermostat incorporated in the cooling water passage, the thermostat being provided at a connection portion between the cooling water supply passage and the bypass passage;

wherein when the temperature of the cooling water lies in a low temperature range lower than a first reference temperature, the thermostat allows introduction of the cooling water from the cooling water discharge passage into the cooling water supply passage via the bypass passage and also prevents introduction of the cooling water from the radiator into the engine via the cooling water supply passage; and wherein when the temperature of the cooling water lies in a high temperature range equal to or higher than a second reference temperature which is higher than the first reference temperature, the thermostat allows introduction of the cooling water from the radiator into the engine via the cooling water supply passage and also prevents introduction of the cooling water from the cooling water discharge passage into the cooling water supply passage via the bypass passage.

With the above-described characterizing arrangement, if the temperature of the cooling water is a temperature lying in the low temperature range, the cooling water from the cooling water discharge passage passes through the bypass passage to flow into the cooling water supply passage, whereas the cooling water from the radiator does not flow into the engine via the cooling water supply passage. Namely, when the temperature of the cooling water is low, this cooling water circulates without passing through the radiator. With this, there can be realized accelerated warmup of the engine. Also, since cooling water having a low temperature does not enter the engine suddenly or directly, the hunting of the cooling water temperature can be reduced.

And, in case the temperature of the cooling water is a temperature lying in the high temperature range, the cooling water from the radiator passes through the cooling water supply passage to enter the engine, whereas the cooling water from the cooling water discharge passage does not flow into the cooling water supply passage via the bypass passage. Namely, when the temperature of the cooling water is high, this cooling water will be caused to pass and circulate through the radiator. With this, cooling of the cooling water can be carried out effectively.

According to one embodiment, when the temperature of the cooling water lies in an intermediate temperature range equal to or higher than the first reference temperature and lower than the second reference temperature, the thermostat allows introduction of the cooling water from the cooling water discharge passage into the cooling water supply passage via the bypass passage and allows also introduction of the cooling water from the radiator to pass through the cooling water supply passage to enter the engine.

With this characterizing arrangement, when the temperature of the cooling water is a temperature lying in the intermediate temperature range, the cooling water from the cooling water discharge passage flows into the cooling water supply passage via the bypass passage and the cooling water from the radiator flows into the engine via the cooling water supply passage. Namely, in the course of transition of the temperature of the cooling water from the low temperature range to the high temperature range, a state of cooling water circulating without passing through the radiator and a state of cooling water passing through and circulating in the radiator coexist. With this the transition from the state of cooling water circulating without passing through the radiator and a state of cooling water passing through and circulating in the radiator can proceed in a smooth manner.

According to one embodiment, the bypass passage branches from an end portion of the cooling water discharge passage on the side of the engine.

With this characterizing arrangement, the cooling water immediately after being discharged from the engine will maintain its temperature to a certain degree and will enter under this state the cooling water supply passage from the cooling water discharge passage via the bypass passage. With this, further acceleration of the engine warmup can be realized.

According to one embodiment, the thermostat is disposed adjacent the end portion of the cooling water discharge passage on the side of the engine.

With this characterizing arrangement, the length of the bypass passage can be reduced.

According to one embodiment, the work vehicle further comprises:

a riding section where a passenger rides; and a cargo carrying bed disposed rearwardly of the riding section;

wherein:

the radiator is disposed forwardly of the riding section;

the engine is disposed downwardly of the cargo carrying bed; and the cooling water supply passage and the cooling water discharge passage are caused to pass under the riding section and provided between the radiator and the engine.

With the above-described characterizing arrangement, accelerated warmup of engine can be realized in a work vehicle having a long cooling water passage.

BRIEF DESCRIPTION OF THE DRAWINGS

FIG. 6 is a view showing relation between cooling water temperatures and operational states of a thermostat.

DETAILED DESCRIPTION OF PREFERRED EMBODIMENTS

Next, an embodiment of the present invention will be explained with reference to the accompanying drawings. In the following explanation, in FIG. 1, a direction of arrow F is defined as "vehicle body front side", a direction of arrow B is defined as "vehicle body rear side", a direction on the left side facing the direction of arrow F is defined as "vehicle body left side" and a direction on the right side facing the direction of arrow F is defined as "vehicle body right side", respectively.

[Generation Arrangement of Multiple-Purpose Vehicle]

Figure 1:
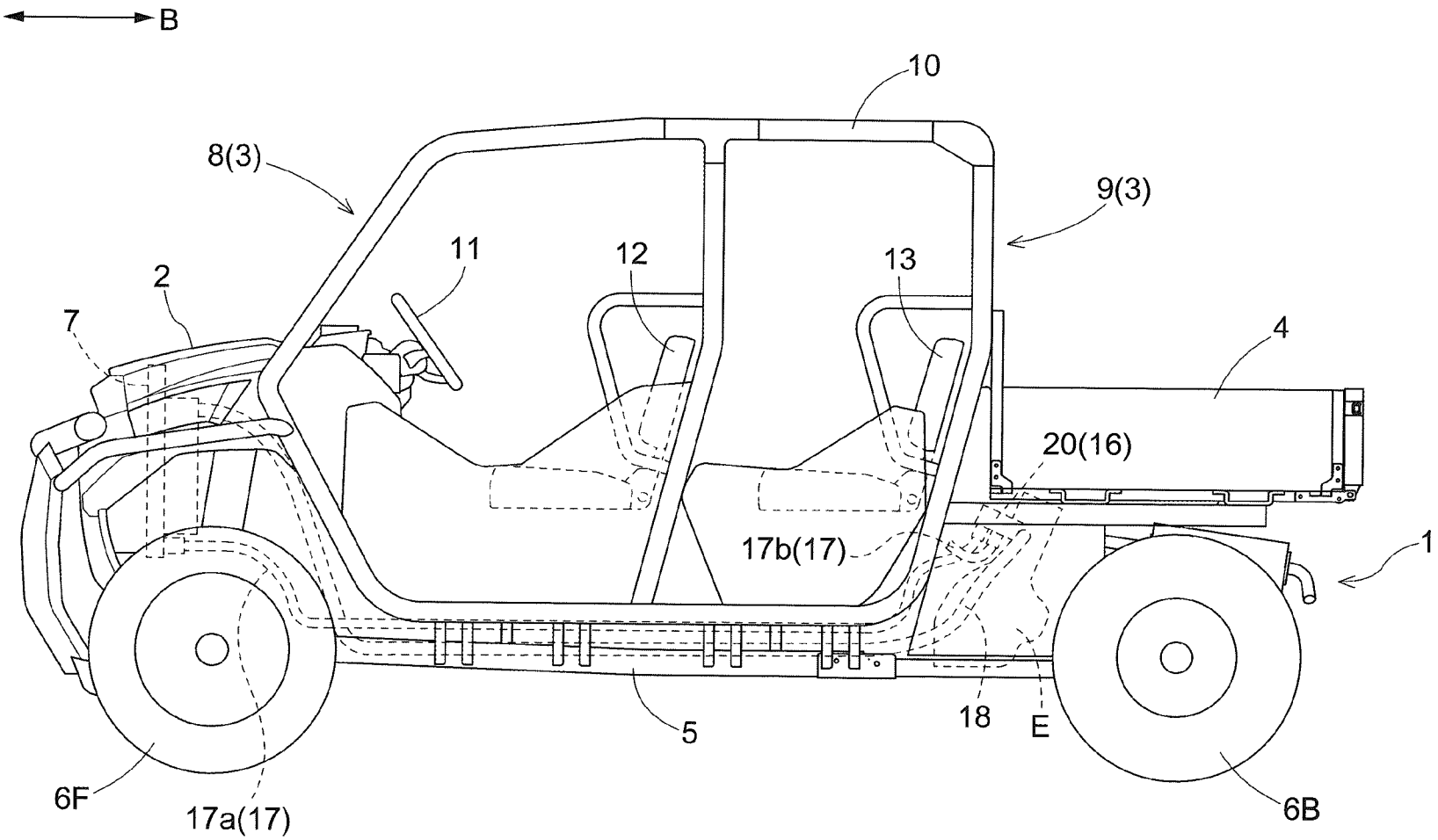
FIG. 1 is a left side view showing a multiple-purpose vehicle.

FIG. 1 shows a utility vehicle (a multiple-purpose vehicle) corresponding to what is referred to as a "work vehicle" relating to the present invention. This vehicle includes a traveling vehicle body 1, an engine hood 2, a riding section 3 where passengers will ride, a dumping type load carrying bed 4, and a water-cooled engine E. The traveling vehicle body 1 includes a vehicle body frame 5, left and right front wheels 6F and left and right rear wheels 6B.

The engine hood 2 is disposed forwardly of the riding section 3. The engine hood 2 accommodates a radiator 7 for cooling water for the engine E, and so on. Namely, the radiator 7 is disposed forwardly of the riding section 3.

The riding section 3 includes a front riding section 8, a rear riding section 9 and a ROPS 10 for protecting passengers. In the front riding section 8, there are provided a steering wheel 11 and a front seat 12. In the rear riding section 9, a rear seat 13 is provided.

The cargo carrying bed 4 is disposed rearwardly of the riding section 3. The engine E is disposed downwardly of the cargo carrying bed 4. The engine E may be a gasoline engine or a diesel engine.

[Engine Cooling Circuit]

Figure 2:
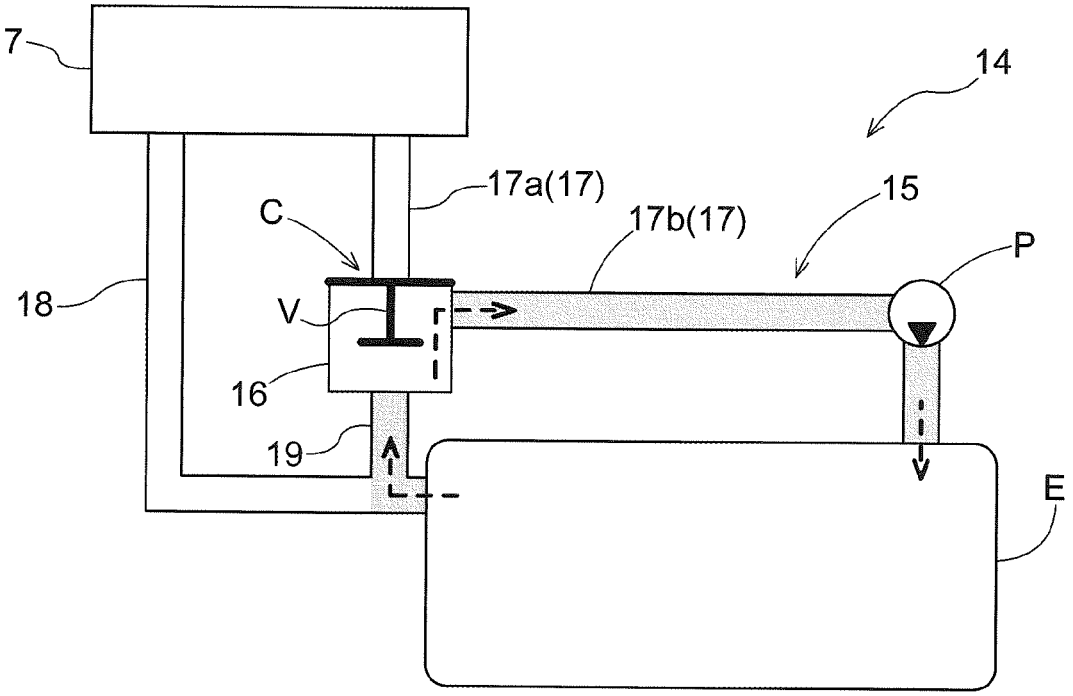
FIG. 2 is a view showing an engine cooling circuit, which is a diagram showing flow of cooling water when the temperature of the cooling water lies in a low temperature range.

As shown in FIG. 2, an engine cooling circuit 14 incorporates the radiator 7, a cooling water passage 15, a thermostat 16 and a cooling water pump P.

The cooling water passage 15 is provided between the engine E and the radiator 7. The cooling water passage 15 includes a cooling water supply passage 17 for supplying cooling water to the engine E, a cooling water discharge passage 18 for discharging cooling water from the engine E, and a bypass passage 19 connecting the cooling water supply passage 17 with the cooling water discharge passage 18.

As shown in FIG. 1, the cooling water supply passage 17 is caused to pass under the riding section 3 and provided between the radiator 7 and the engine E. The cooling water supply passage 17 is constituted of a pipe member. An end portion of the cooling water supply passage 17 on the side of the radiator 7 is connected to a lower portion of the radiator 7. The cooling water supply passage 17 includes a first passage portion 17*a* disposed closer to the radiator 7 side than the thermostat 16 and a second passage portion 17*b* disposed closer to the engine E side than the thermostat 16.

The cooling water discharge passage 18 is caused to pass under the riding section 3 and provided between the radiator 7 and the engine E. The cooling water discharge passage 18 is constituted of a pipe member. An end portion of the cooling water discharge passage 18 on the side of the radiator 7 is connected to an upper portion of the radiator 7.

As shown in FIG. 2, the bypass passage 19 branches from the end portion of the cooling water discharge passage 18 on the side of the engine E. In the cooling water passage 15, the thermostat 16 is provided at a connection portion C between the cooling water supply passage 17 and the bypass passage 19. The thermostat 16 includes a valve V. The thermostat 16 is disposed adjacent the end portion of the cooling water discharge passage 18 on the side of the engine E. In other words, the thermostat 16 is disposed at a position adjacent the engine E (see FIG. 3).

Figure 3:
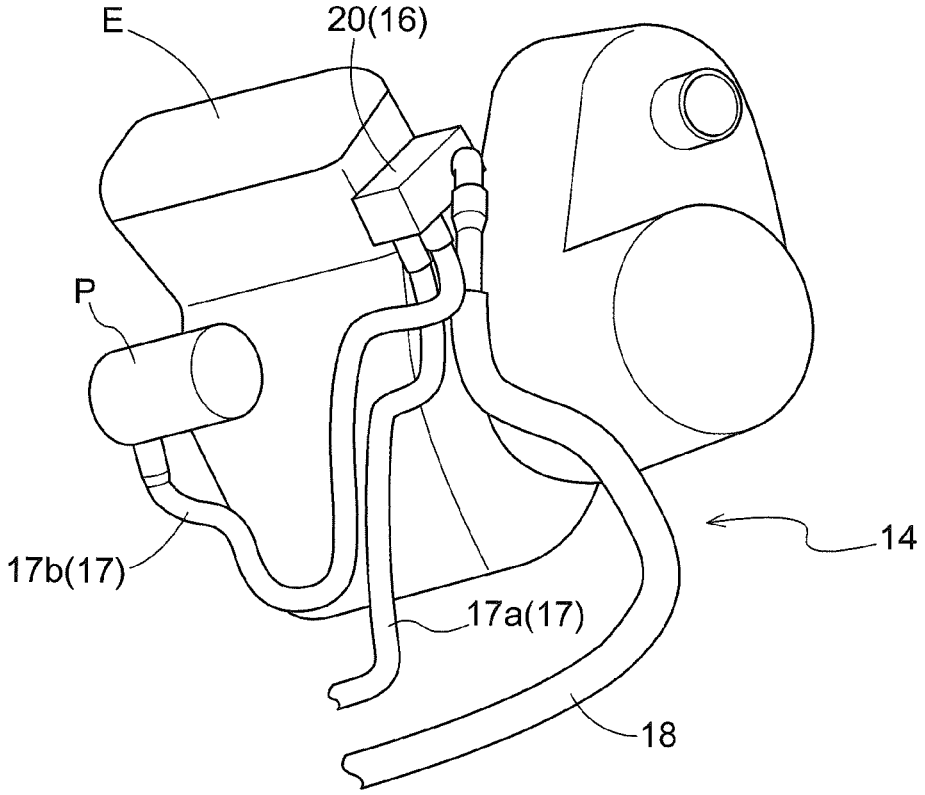
FIG. 3 is a perspective view showing the engine cooling circuit.

As shown in FIG. 3, the thermostat 16 is held as being accommodated within a holder member 20. The holder member 20 is supported to the engine E. More particularly, the holder member 20 is attached to a left side portion of the engine E.

To the holder member 20, the first passage portion 17*a*, the second passage portion 17*b* and the cooling water discharge passage 18 are connected respectively. In the instant embodiment, inside the holder member 20, the bypass passage 19 is formed.

The cooling water pump P is provided for pressure-feeding an amount of cooling water present inside the cooling water supply passage 17 (second passage portion 17*b*) to the engine E. The cooling water pump P is provided to the front face side of the engine E (see FIG. 3). To this cooling water pump P, the end portion of the second passage portion 17*b* on the side of the engine E is connected.

[Operational States of Thermostat]

As shown in FIG. 2 and FIG. 6, when the temperature T of cooling water is a temperature lying in a low temperature range lower than a first reference temperature T1, the thermostat 16 allows introduction of cooling water from the cooling water discharge passage 18 to pass through the bypass passage 19 to flow into the cooling water supply passage 17 and also prevents introduction of the cooling water from the radiator 7 into the engine E via the cooling water supply passage 17. Incidentally, dotted-like bold arrow signs in FIG. 2 show the flows of the cooling water.

Specifically, when the temperature T of cooling water is a temperature lying in the low temperature range lower than the first reference temperature T1, the valve V blocks communication between the first passage portion 17*a* and the second passage portion 17*b* and allows communication between the bypass passage 19 and the second passage portion 17*b*.

Figure 4:
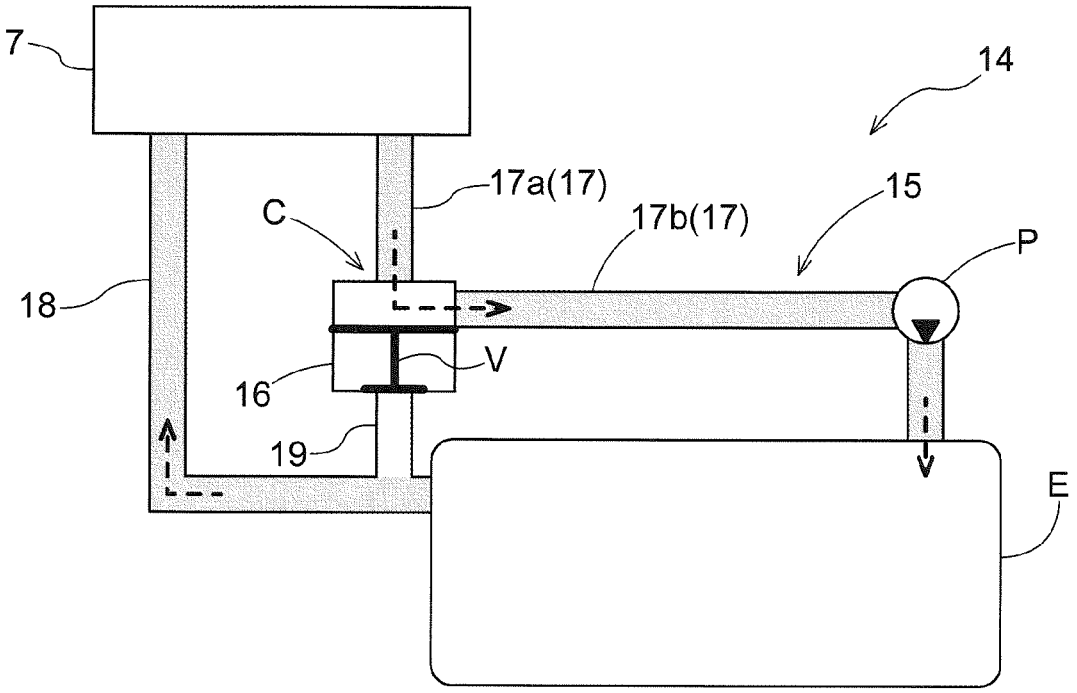
FIG. 4 is a view showing the engine cooling circuit, which is a diagram showing flow of cooling water when the temperature of the cooling water lies in a high temperature range.

As shown in FIG. 4 and FIG. 6, when the temperature T of cooling water is a temperature lying in a high temperature range equal to or higher than a second reference temperature T2 higher than the first reference temperature T1, the thermostat 16 allows introduction of cooling water from the radiator 7 to the engine E via the cooling water supply passage 17 and also prevents introduction of the cooling water from the cooling water discharge passage 18 into the cooling water supply passage 17 via the bypass passage 19. Incidentally, dotted-like bold arrow signs in FIG. 4 show the flows of the cooling water.

Specifically, when the temperature T of cooling water is a temperature lying in the high temperature range equal to or higher than the second reference temperature T2 higher than the first reference temperature T1, the valve V allows communication between the first passage portion 17*a* and the second passage portion 17*b* and also blocks communication between the bypass passage 19 and the second passage portion 17*b*.

Figure 5:
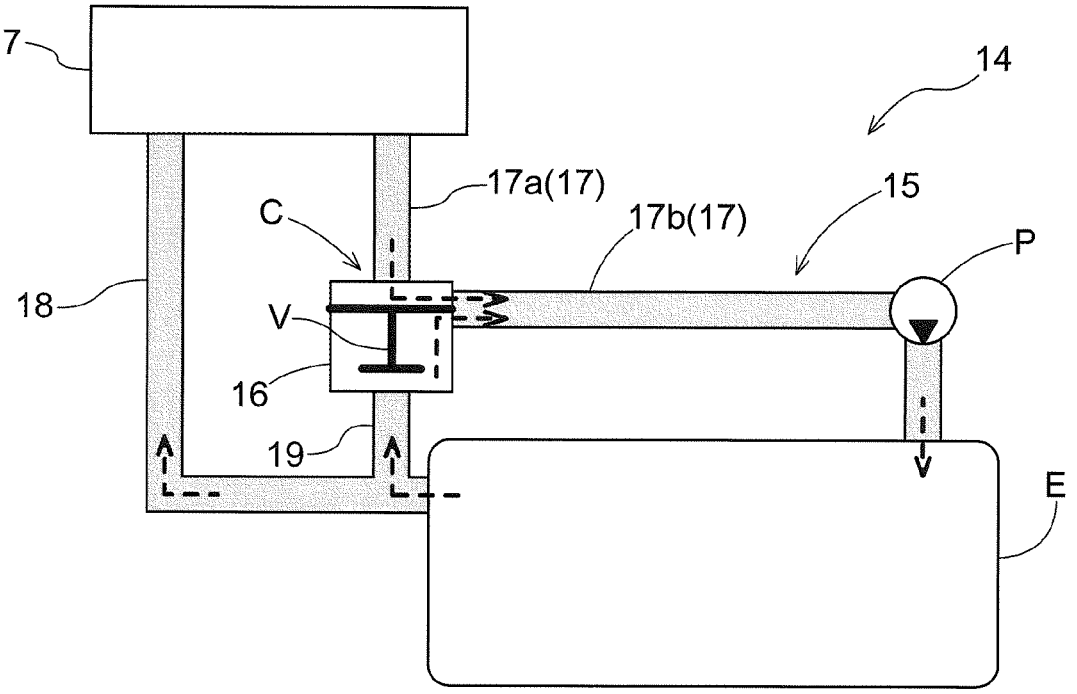
FIG. 5 is a view showing the engine cooling circuit, which is a diagram showing flow of cooling water when the temperature of the cooling water lies in an intermediate temperature range.

As shown in FIG. 5 and FIG. 6, when the temperature T of cooling water is a temperature lying in an intermediate temperature range equal to or higher than the first reference temperature T1 and lower than the second reference temperature T2, the thermostat 16 allows introduction of cooling water from the cooling water discharge passage 18 to the cooling water supply passage 17 via the bypass passage 19 and also allows introduction of cooling water from the radiator 7 to the engine E via the cooling water supply passage 17. Incidentally, dotted-like bold arrow signs in FIG. 5 show the flows of the cooling water.

Specifically, when the temperature T of cooling water is a temperature lying in the intermediate temperature range equal to or higher than the first reference temperature T1 and lower than the second reference temperature T2, the valve V allows communication between the first passage portion 17*a* and the second passage portion 17*b* and also allows communication between the bypass passage 19 and the second passage portion 17*b*.

Other Embodiments (1) In the foregoing embodiment, the bypass passage 19 is formed inside the holder member 20. Alternatively, the bypass passage 19 may be constituted of a pipe member.

(2) In the foregoing embodiment, the bypass passage 19 branches from the end portion of the cooling water discharge passage 18 on the side of the engine E. Alternatively, the bypass passage 19 may branch from any other portion of the cooling water discharge passage 18 other than the end portion on the side of the engine E. For instance, the bypass passage 19 may branch from the end portion of the cooling water discharge passage 18 on the side of the radiator 7. Further alternatively, the bypass passage 19 may branch from a center portion or an approximately center portion of the cooling water discharge passage 18 between the end portion on the side of the engine E and the end portion on the side of the radiator 7.

(3) In the foregoing embodiment, the thermostat 16 is disposed adjacent the engine E side end portion of the cooling water discharge passage 18. Alternatively, the thermostat 16 may be disposed at a portion away from the engine E side end portion of the cooling water discharge passage 18.

(4) The present invention is applicable not only to a multiple-purpose vehicle, but also to an agricultural work vehicle such as a tractor, a combine, a rice planter, etc. or to a civil engineering work vehicle.

The invention claimed is:

1. A work vehicle comprising:

a water-cooled engine;

a radiator for cooling water for cooling the engine;

a thermostat holder attached to a portion of the water-cooled engine;

a cooling water passage provided between the engine and the radiator, the cooling water passage including:

a cooling water supply passage for supplying the cooling water to the engine;

a cooling water discharge passage for discharging the cooling water from a side of the engine; and a bypass passage that connects the cooling water supply passage with the cooling water discharge passage; and a thermostat incorporated in the cooling water passage, the thermostat being provided at a connection portion between the cooling water supply passage and the bypass passage, the thermostat being held within the thermostat holder;

wherein when the temperature of the cooling water lies in a low temperature range lower than a first reference temperature, the thermostat allows introduction of the cooling water from the cooling water discharge passage into the cooling water supply passage via the bypass passage and also prevents introduction of the cooling water from the radiator into the engine via the cooling water supply passage;

wherein when the temperature of the cooling water lies in a high temperature range equal to or higher than a second reference temperature which is higher than the first reference temperature, the thermostat allows introduction of the cooling water from the radiator into the engine via the cooling water supply passage and also prevents introduction of the cooling water from the cooling water discharge passage into the cooling water supply passage via the bypass passage;

wherein the bypass passage is formed inside the thermostat holder;

wherein the bypass passage branches from an end portion of the cooling water discharge passage that is adjacent to the side of the engine;

wherein the thermostat is disposed adjacent the end portion of the cooling water discharge passage that is adjacent to the side of the engine;

wherein the cooling water supply passage comprises:

a first passage portion disposed between the radiator and the thermostat; and a second passage portion disposed between the thermostat and the engine; and wherein the first passage portion and the second passage portion are connected to the thermostat holder and each extend downward from the thermostat holder.

2. The work vehicle of claim 1, wherein when the temperature of the cooling water lies in an intermediate temperature range equal to or higher than the first reference temperature and lower than the second reference temperature, the thermostat allows introduction of the cooling water from the cooling water discharge passage into the cooling water supply passage via the bypass passage and allows also introduction of the cooling water from the radiator to pass through the cooling water supply passage to enter the engine.

3. The work vehicle of claim 1, further comprising:

a riding section where a passenger rides; and a cargo carrying bed disposed rearwardly of the riding section;

wherein:

the radiator is disposed forwardly of the riding section;

the engine is disposed downwardly of the cargo carrying bed; and the cooling water supply passage and the cooling water discharge passage are caused to pass under the riding section and provided between the radiator and the engine.

* * * * *